US005205662A

United States Patent [19]

Kurokawa et al.

[11] Patent Number: 5,205,662

[45] Date of Patent: Apr. 27, 1993

[54] METHOD OF FEEDING PAPER

[75] Inventors: Noriyuki Kurokawa; Akio Tajima; Kazuaki Ikeda, all of Tokyo, Japan

[73] Assignee: Seikosha Co., Ltd., Tokyo, Japan

[21] Appl. No.: 838,389

[22] Filed: Feb. 19, 1992

[30] Foreign Application Priority Data

Feb. 21, 1991 [JP] Japan ..... 3-027542

[51] Int. Cl.[5] ..... B41J 11/58

[52] U.S. Cl. ..... 400/636; 400/283; 400/645

[58] Field of Search ..... 400/624, 625, 629, 630, 400/631, 632, 632.1, 607.3, 608.2, 608.3, 608.4, 636, 636.1, 636.2, 636.3, 637, 637.1, 645, 708, 708.1, 283

[56] References Cited

U.S. PATENT DOCUMENTS 4,362,409 12/1982 Endo ..... 400/625
4,688,957 8/1987 Prevignano ..... 400/605
4,744,687 5/1988 Nukaya et al. ..... 400/629
4,812,065 3/1989 Shimogawara et al. ..... 400/624
4,986,525 1/1991 Takagi et al. ..... 400/629
4,995,745 2/1991 Yokoi et al. ..... 400/605

FOREIGN PATENT DOCUMENTS 63-53073 3/1988 Japan .
WO89/04768 6/1989 PCT Int'l Appl. .

*Primary Examiner*—Eugene H. Eickholt
*Attorney, Agent, or Firm*—Jordan and Hamburg

[57] ABSTRACT

Method of feeding a sheet of paper in a small-sized paper having small transport rollers mounted downstream of the print head. The feeding of the sheet is stopped temporarily when the sheet arrives at each of a number of positions located before the discharge rollers during a line feed operation. Under this interrupted condition, the print head is reciprocated once idly in a direction perpendicular to the direction in which the sheet is fed. Therefore, even if the front end portion of the sheet curls to a great extent, the curl is reduced by the idle movement of the head immediately before the front end of the sheet arrives between the discharge rollers. This ensures that the sheet is fed between the discharge rollers even if the diameter of the rollers is small.

10 Claims, 10 Drawing Sheets

METHOD OF FEEDING PAPER

FIELD OF THE INVENTION

The present invention relates to a method of feeding paper used in a serial printer having a print head moved perpendicular to the direction of paper feeding.

BACKGROUND OF THE INVENTION

In a serial printer, a pair of transport rollers are mounted downstream of a print head. Paper is fed between these rollers. After characters are printed on the paper, it is held between the rollers and conveyed.

Portable and miniature personal computers and word processors have been developed. These small-sized machines are known as notebook-size computers and word processors and as laptop computers and word processors. With this trend, there is a demand for portable and small-sized printers.

When a printer is miniaturized, it is necessary to miniaturize the components. This is described now in further detail by referring to FIG. 10 which shows the prior art serial printer. Transport rollers 101 are mounted downstream of a print head 100. In order to achieve the miniaturization, the diameter of the rollers 101 must be reduced. When the diameter of the transport rollers 101 is small, if the front end of paper 102 curls to a great extent as indicated by the phantom line, then the possibility arises that the paper 102 cannot be transported between the rollers 101.

SUMMARY OF THE INVENTION

It is an object of the present invention to provide a method of feeding paper without difficulty if transport rollers mounted downstream of a print head are designed to have a small diameter.

The present invention lies in a method of feeding paper between a pair of transport rollers mounted downstream of a print head. The method is characterized in that the print head is caused to make at least one idle movement in a direction perpendicular to the direction of paper feeding immediately before the front end of paper arrives between the rollers, and that the paper is then transported between the transport rollers.

In the novel method of feeding paper, the head is caused to make at least one idle movement immediately before the front end of the paper is caught between the transport rollers. Thereafter, the paper is fed between the transport rollers. Therefore, if the front end of the paper curls, the amount of the curl can be reduced by the idle movement of the head immediately before the front end of the paper arrives between the transport rollers. This ensures that the paper is fed between the rollers even if the diameter of the rollers is small.

Other objects and features of the invention will appear in the course of the description thereof which follows.

DETAILED DESCRIPTION OF THE INVENTION

Figure 1:
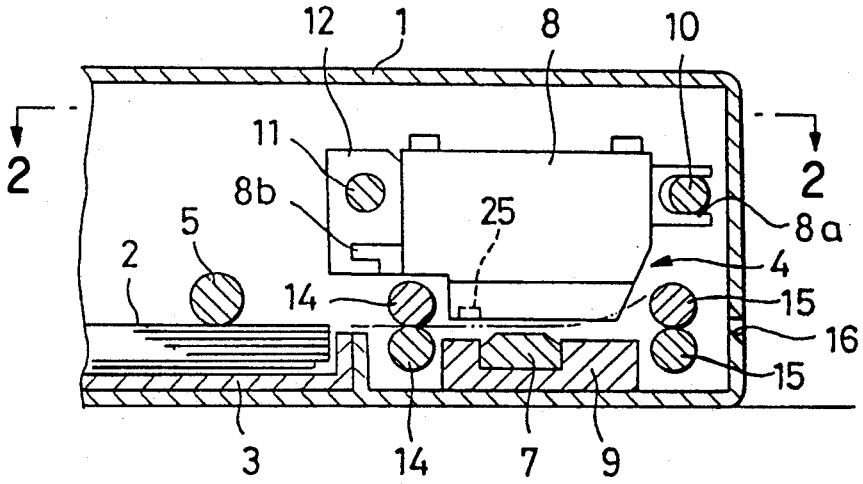
FIG. 1 is a vertical cross section of a serial printer according to the invention.

Referring to FIG. 1, there is shown a serial printer which feeds paper in accordance with the present invention. The printer comprises a case 1 in which a paper cassette 3 holding sheets of paper 2 is installed. The sheets of paper 2 are successively fed out of this cassette 3 to a printing mechanism 4 to print characters on the sheets. A picking roller 5 is mounted above the cassette 3 and rotated by a picking motor 6 (FIG. 3) to take each sheet of paper 2 out of the paper cassette 3.

Figure 2:
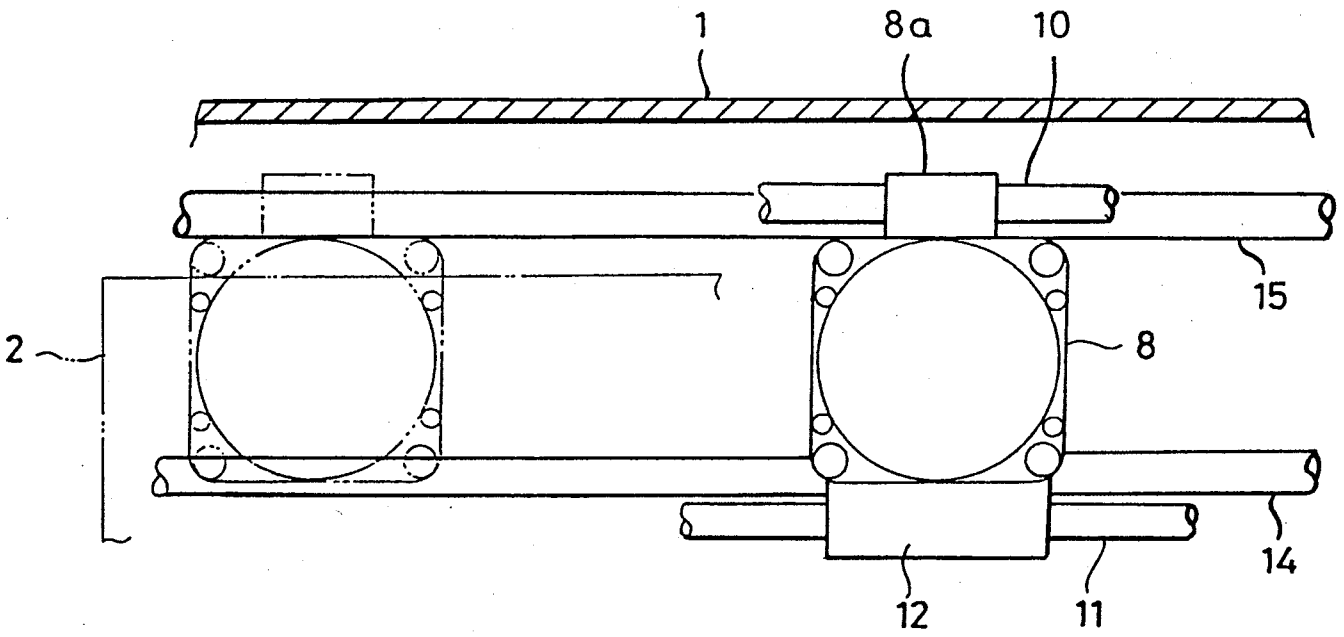
FIG. 2 is a cross-sectional view taken along line 2—2 of FIG. 1, for showing main portions of the printer shown in FIG. 1.
Figure 3:
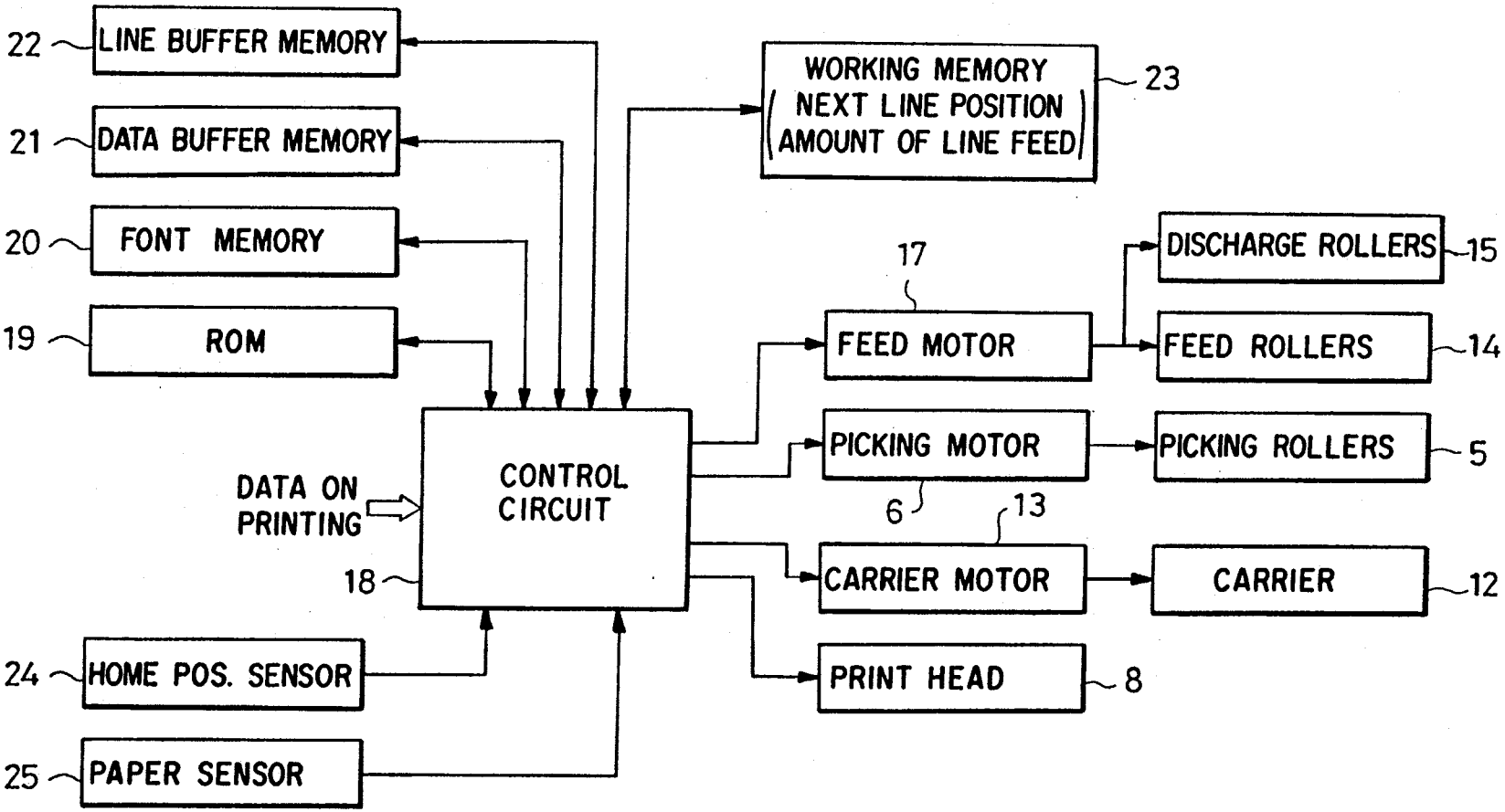
FIG. 3 is a block diagram of the circuit of the main mechanism of the printer shown in FIG. 1.

The printing mechanism 4 comprises a platen 7 and a print head 8 that is disposed opposite to the platen 7. Each sheet of paper 2 is fed between the head 8 and the platen 7, and then characters are printed on this sheet. The platen 7 is fixedly mounted to a frame 9 which is mounted inside the case 1. The platen 7 extends perpendicular to the direction in which the sheet is fed, i.e., perpendicular to the plane of the sheet of FIG. 1. As shown in FIGS. 1 and 2, one end of the print head 8 slidably engages a guide shaft 10. A carrier 12 engaging another guide shaft 11 is coupled to the other end of the head 8, the shaft 11 extending parallel to the shaft 10. The head 8 can move perpendicular to the direction of paper feeding while guided by the guide shafts 10 and 11. A U-shaped receiving part **8*a* is formed at one end of the head 8. The guide shaft 10 engages this receiving part 8*a*. A projecting part 8*b* is formed at the other end of the head 8 and acts to anchor the head 8 to the carrier 12. The carrier 12 is moved parallel to the platen 7, i.e., perpendicular to the direction of paper feeding, by a carrier motor 13 (FIG. 3**).

Figure 4:
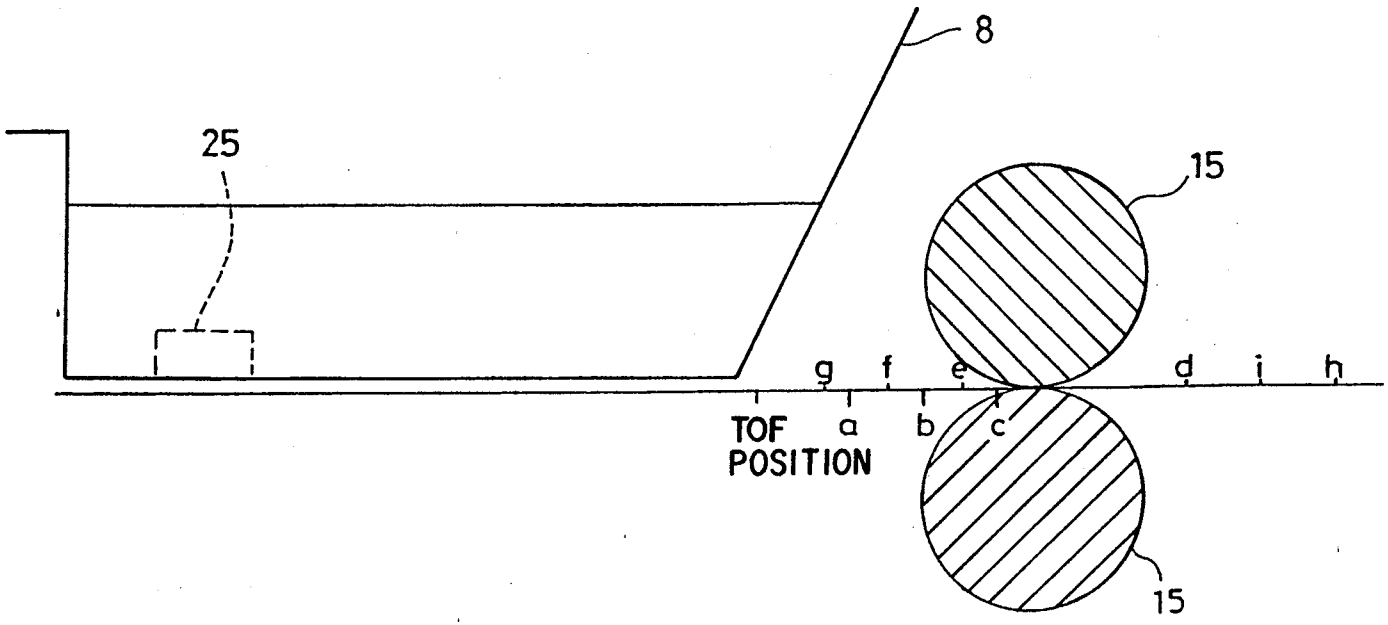
FIG. 4 is a fragmentary enlarged cross section of the printer shown in FIG. 1.

A pair of feed rollers 14 and a pair of discharge rollers 15 are mounted upstream and downstream, respectively, of the printing mechanism 4. Each sheet of paper 2 is fed between the print head 8 and the platen 7 by the feed rollers 14. The sheet 2 is transported to a discharge port 16 formed in the printer case 1. The sheet 2 on which characters have been printed is taken out of the case 1 through this discharge port 16. The discharge rollers 15 are located downstream of the front end of the sheet of paper 2 that is at the TOF (top of form) position as shown in FIG. 4. These rollers 14 and 15 are rotated by a feed motor 17 shown in FIG. 3. The feed motor 17, the carrier motor 13, the print head 8, and the picking motor 6 are connected with a control circuit 18, as shown in FIG. 3.

A real-only memory (ROM) 19, a font memory 20, a data buffer memory 21, a line buffer memory 22, a working memory 23, a home position sensor 24, and a paper sensor 25 are connected with the control circuit 18. The control circuit 18 controls the operation of the feed motor 17, the carrier motor 13, the print head 8, and the picking motor 6 in response to signals from these components 19–25. A control program has been previously loaded in the ROM 19. Data about fonts corresponding character data has been previously loaded in the font memory 20. The data buffer memory 21 is a random-access memory (RAM) in which print data entered to the control circuit 18 is temporarily stored. The line buffer memory 22 is a RAM in which font data read into the control circuit 18 from the font memory 20 is temporarily stored. The working memory 23 can store the next line position and the amount of line feed in response to driving pulses applied to the feed motor 17. The home position sensor 24 can sense that the print head 8 is in its home position indicated by the phantom line in FIG. 2. As shown in FIG. 1, the paper sensor 25 is installed on the print head 8 and detects the presence, absence, or passage of the sheet of paper 2.

When the print head is shifted from the TOF position to the next line, the feeding of the sheet 2 is temporarily stopped at three positions a, b, and c (FIG. 4) which are located between the front end (the TOF position in FIG. 4) of the sheet 2 and the discharge rollers 15, irrespective of the presently established amount of line feed. Under these halted conditions, the head 8 is reciprocated once without being activated for printing. This operation will hereinafter be referred to as an idle movement. One reciprocation of the head 8 means that if the print head 8 is in its home position, the head 8 is returned to it home position after shifted to the end opposite the home position, and that if the head 8 is located in an intermediate position, then the head is once moved to its home position, after which the above-described operation is carried out.

The numbers of the driving pulses applied to the feed motor 17 until the sheet is moved from the TOF position to the positions a, b, and c, respectively, are stored in the working memory 23. The spacing between these positions is set to one third of the pitch between the successive lines.

Figure 5:
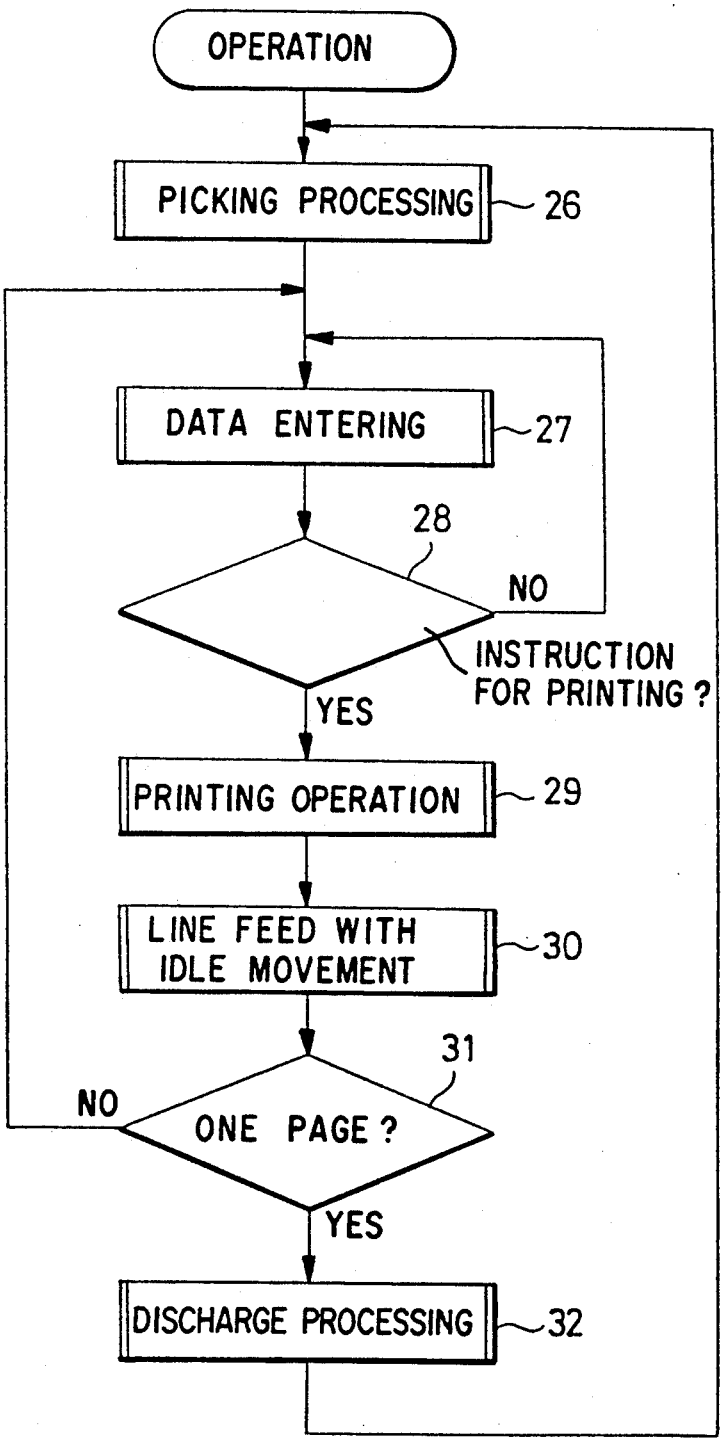
FIG. 5 is a flowchart illustrating the general operation of the printer shown in FIG. 1.

The printing operation is next described by referring to the flowchart of FIG. 5. If a picking instruction is received, then the picking roller 5 and the feed rollers 14 are driven to perform picking processing (step 26). Various kinds of data for printing are entered to the control circuit 18 (step 27). When such an instruction for printing arrives (step 28), the print head 8 is activated and the carrier 12 is driven to perform a printing operation (step 29). After one line of characters is printed, the feed rollers 14 and the discharge rollers 15 are driven to perform a line feed operation involving an idle movement (step 30). On completion of printing of one page (step 31), the discharge rollers 15 are driven to discharge the sheet of paper (step 32). Subsequently, control goes back to step 26. Then, the same process is repeated.

Figure 6:
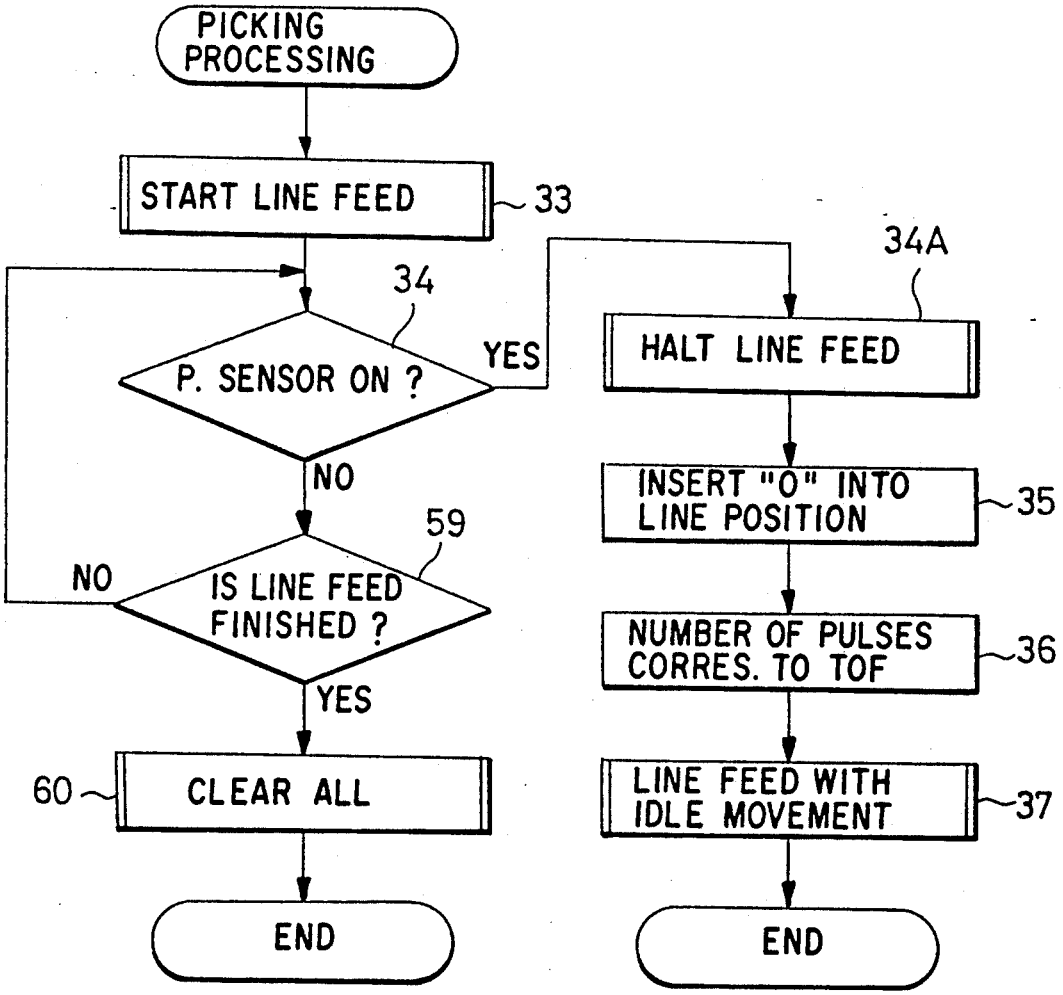
FIG. 6 is a flowchart illustrating a picking operation performed by the printer shown in FIG. 1.

The picking processing is described next by referring to the flowchart of FIG. 6. The picking roller 5 and the feed rollers 14 are driven to initiate a line feed operation (step 33). The front end of the sheet of paper 2 passes across the paper sensor 25, turning on the sensor (step 34). The line feed operation is halted (step 34A). Next Line position "0" is placed in the working memory 23 shown in FIG. 3 (step 35). At the same time, the number of the pulses corresponding to the TOF position is established as the amount of line feed (step 36). Thereafter, a line feed operation involving an idle movement is effected in response to the signal which is delivered to the control circuit 18 from the working memory 23 (step 37). By this line feed operation, the rear end of the sheet 2 passes across the paper sensor 25, turning off it (step 34). When the line feed operation is completed (step 59), the various kinds of data which have been entered to the control circuit 18 for printing are cleared. Thus, preparations are made for the next picking processing (step 60).

Figure 7:
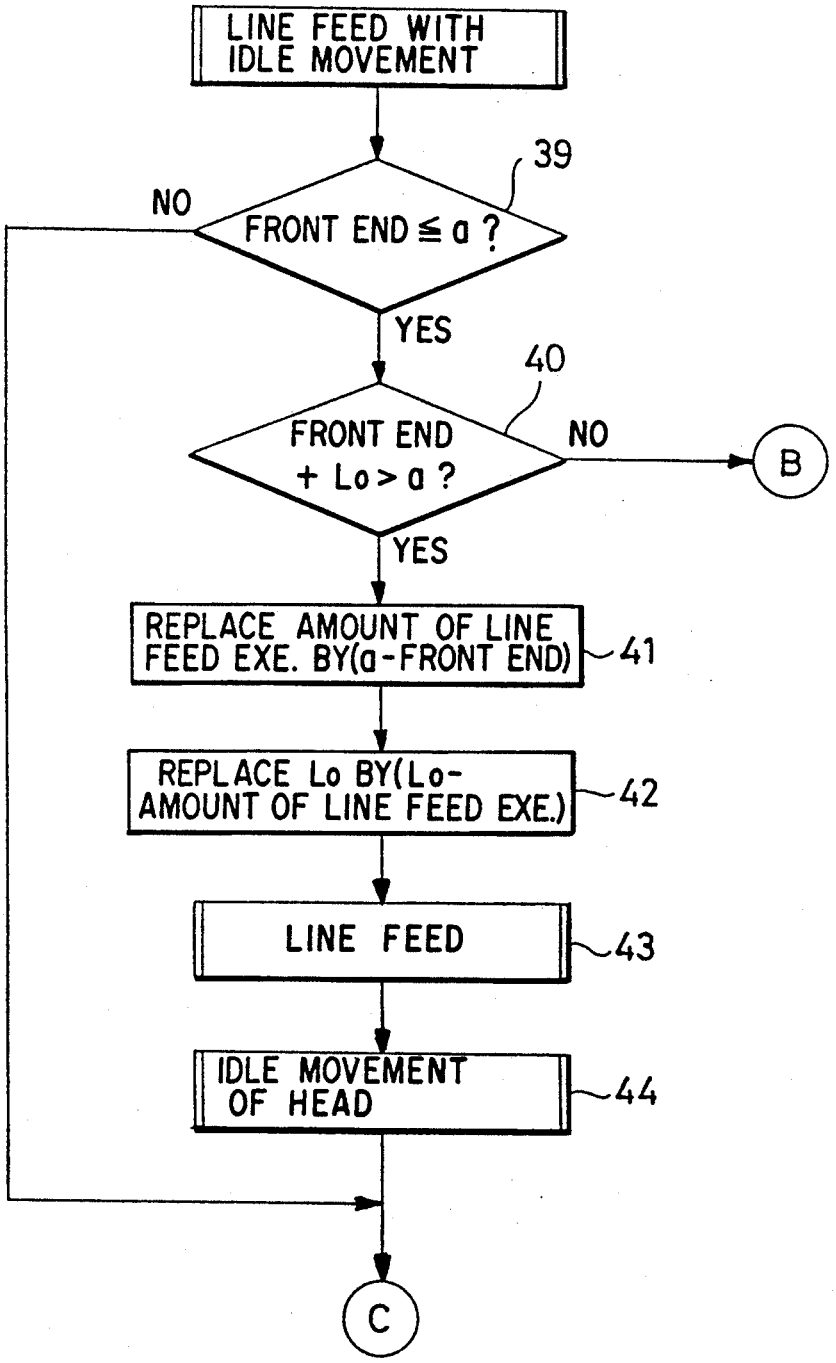
FIG. 7 is a flowchart illustrating a line feed operation performed by the printer shown in FIG. 1, the line feed operation involving an idle movement.
Figure 8:
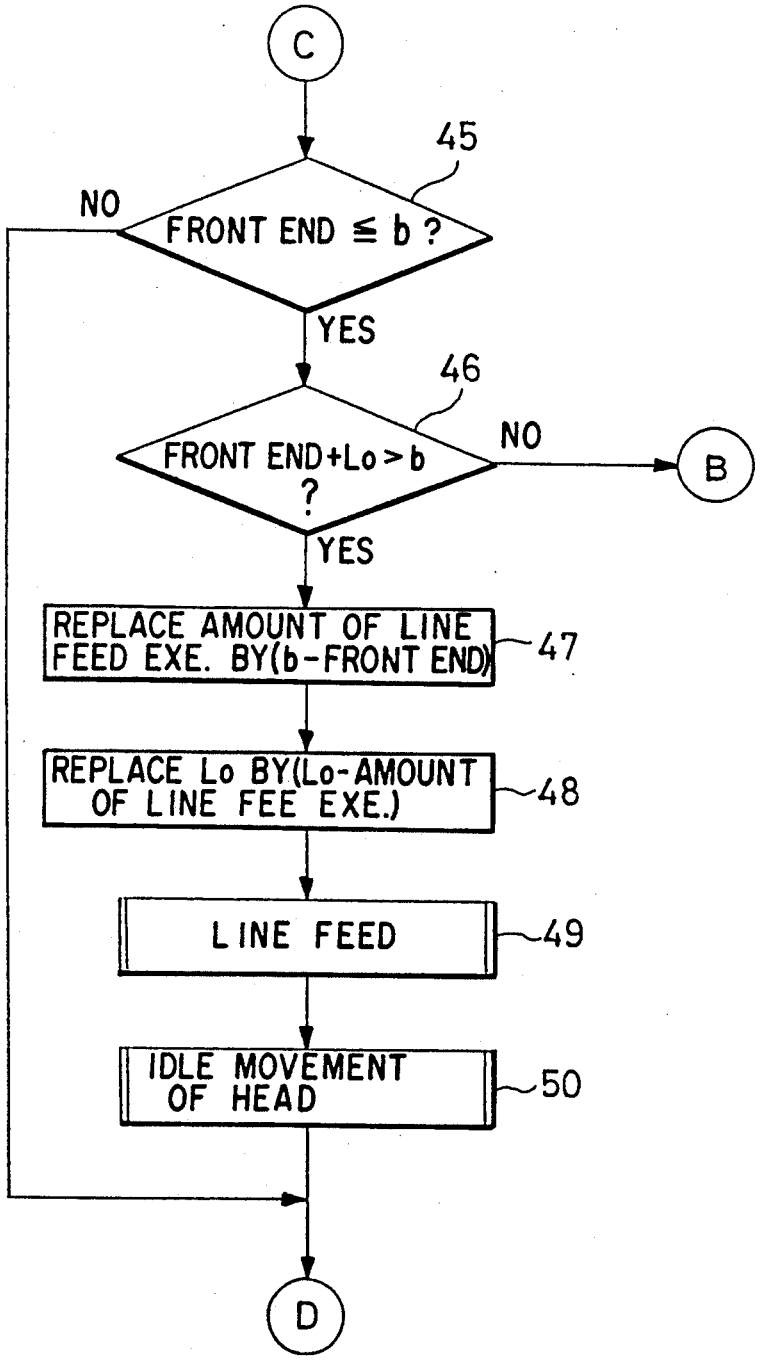
FIG. 8 is a flowchart illustrating another line feed operation performed by the printer shown in FIG. 1, the line feed operation involving an idle movement.
Figure 9:
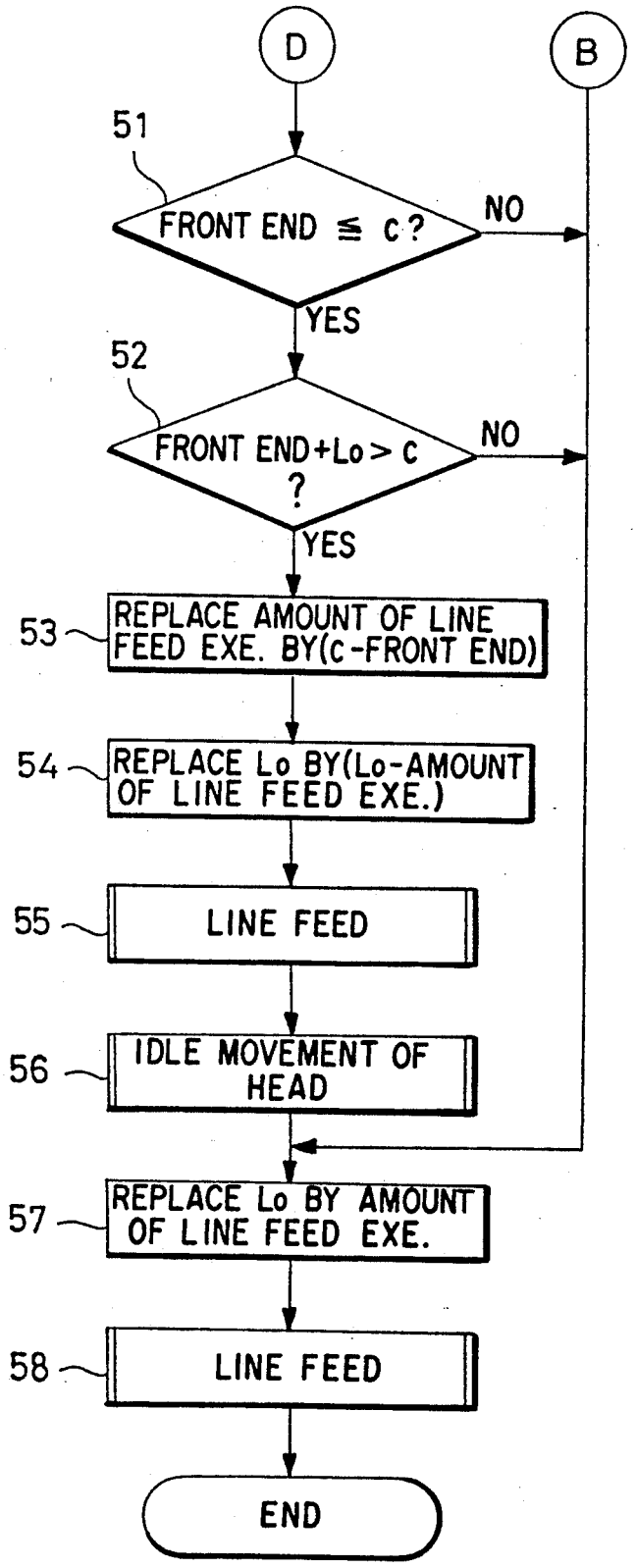
FIG. 9 is a flowchart illustrating a further line feed operation performed by the printer shown in FIG. 1, the line feed operation involving an idle movement.
Figure 10:
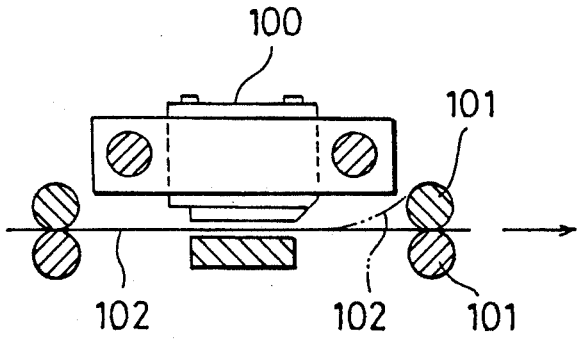
FIG. 10 is a vertical cross section of the prior art serial printer.

The line feed operation involving an idle movement is described in further detail now. The sheet of paper 2 is brought into the TOF position by the first line feed operation. In this TOF position, the sheet 2 is placed in such a position that the first line can be printed by the print head 8. At this time, the front end of the sheet 2 lies between the paper sensor 25 and the position a as shown in FIG. 4. The next line feed operation is started at this TOF position. Before this line feed operation, the position of the next line has been previously specified according to the print data entered to the data buffer memory 21. The line feed operation is carried out in such a manner that the sheet 2 reaches the specified next line position. The number of the driving pulses applied to the feed motor 17 until the sheet 2 reaches the specified line position is stored in the working memory 23 as the specified line position. This line position is established according to the printing data entered to the data buffer memory 21. When the next line feed operation is commenced at the TOF position, the specified line position may be determined from the positions a, b, and c to realize the following situations: As shown in FIG. 4, after the front end of the sheet 2 passes across the positions a, b, and c, the front end reaches a position d. The front end of the sheet 2 reaches a position e located between the positions b and c. The front end of the sheet 2 reaches a position f between the positions a and b. The front end of the sheet 2 reaches a position g located before the position a. The manner in which the line feed operation involving an idle movement is started at the TOF position is described below by referring to FIGS. 7–9 for all of these cases.

Where the specified line position is so determined that the front end of the sheet 2 reaches the position d, the line feed operation is performed in the manner described now. When the specified line position is set to this position, the amount of line feed to the next line position (hereinafter referred to as the established amount of line feed $L_o$) is set to the distance between the position d and the TOF position. The number of the driving pulses applied to the feed motor 17 is stored in the working memory 23 as this established amount of line feed $L_o$.

A decision is made (step 39), based on the signal delivered to the control circuit 18 from the working memory 23, to see whether the front end of the sheet 2 has reached the position a (FIG. 4) when the TOF position is taken up. After the established amount of line feed $L_o$ is traveled from the TOF position, a decision is made to ascertain whether the front end of the sheet 2 passes across the position a (step 40). The amount of line feed to be executed is determined from the result of this decision. That is, the amount of line feed to be carried out is the distance between the position a and the position of the front end of the sheet 2, or the distance between the position a and the TOF position (step 41). The established amount of line feed $L_o$ is updated to the difference between the established amount of line feed $L_o$ and the amount of line feed executed, i.e., (the distance between the position d and the TOF position)−(the distance between the position a and the TOF position)=the distance between the positions d and a (step 42). The number of the driving pulses applied to the feed motor 17 is stored as the amount of line feed executed and as the established amount of line feed $L_o$ in the working memory 23. The line feed operation is executed in response to the signal delivered from the working memory 23 to the control circuit 18 by causing the sheet to move a distance equal to the amount of line feed executed, i.e., the distance between the position a and the TOF position (step 43). By this line feed operation, the front end of the sheet 2 is moved from the TOF position into the position a. At this time, the number of the driving pulses applied to the feed motor 17 until the front end of the sheet moves from the TOF position to the position a is stored in the working memory 23 as the position a assumed by the front end of the sheet 2 at this time. When the front end of the sheet 2 reaches this position, the print head 8 is reciprocated once idly (step 44).

Then, a decision is made to determine whether the front end position a of the sheet 2 stored in the working memory 23 has reached the position b (FIG. 4) (step 45). Also, a decision is made to see if the front end of the sheet 2 passes across the position b after the line position is varied from the position a by the established amount of line feed $L_o$, or the distance between the positions d and a (step 46). According to the results of these decisions, the amount of line feed executed is set to the distance between the position b and the front end position of the sheet 2, i.e., the distance between the positions b and a (step 47). Also, the established amount of line feed $L_o$ is updated to the difference between the established amount of line feed $L_o$ and the amount of line feed executed, i.e., (the distance between the positions d and a)−(the distance between the positions b and a)=the distance between the positions d and b (step 48). The number of the driving pulses applied to the feed motor 17 is stored as the amount of line feed executed and as the established amount of line feed $L_o$ in the working memory 23. A line feed operation is carried out in response to the signal produced from the working memory 23 to the control circuit 18 by moving a distance equal to the amount of line feed executed, i.e., the distance between the positions b and a (step 49). By this line feed operation, the front end of the sheet 2 is moved from the position a into the position b. The number of the driving pulses applied to the feed motor 17 is stored in the working memory 23 as the position b assumed by the front end of the sheet 2 at this time. When the front end of the sheet 2 arrives at this position, the print head 8 is again reciprocated once idly (step 50).

Thereafter, a decision is made to determine whether the front end position b of the sheet 2 stored in the working memory 23 has reached the position c (FIG. 4) (step 51). Also, a decision is made to see if the front end position d of the sheet 2 passes across the position c after the established amount of line feed $L_o$ is traveled from the position b (step 52). Based on the results of these decisions, the established amount of line feed is set to the distance between the position c and the front end position of the sheet 2, i.e., the distance between the positions c and b (step 53). The established amount of line feed $L_o$ is updated to the difference between the established amount of line feed $L_o$ and the amount of line feed executed, i.e., (the distance between the positions d and b)−(the distance between the positions c and b)=the distance between the positions d and c (step 54). The number of the driving pulses applied to the feed motor 17 is stored in the working memory 23 as the amount of line feed executed and as the established amount of line feed $L_o$. A line feed operation is effected in response to the signal delivered from the working memory 23 to the control circuit 18 by moving a distance equal to the amount of line feed executed, i.e., the distance between the positions c and b (step 55). By this line feed operation, the front end of the sheet 2 is moved from the position b to the position c. The number of the driving pulses applied to the feed motor 17 until the front end goes from the TOF position to the position c is stored in the working memory 23 as the position c assumed by the front end of the sheet 2 at this time. When the front end of the sheet 2 arrives at this position, the print head 8 is again reciprocated once idly (step 56).

Thereafter, the amount of line feed executed is set to the established amount of line feed $L_o$, i.e., the distance between the positions d and c (step 57). The number of the driving pulses applied to the feed motor 17 is stored in the working memory 23 as this amount of line feed executed. A line feed operation is carried out according to the signal produced from the working memory 23 to the control circuit 18 by moving a distance equal to the established amount of line feed $L_o$ (step 58). Thus, the front end of the sheet 2 moves from the position c to the position d, so that the sheet 2 is brought to the specified line position.

After the sheet of paper 2 reaches this specified line position, the next line feed operation is performed. At this time, the established amount of line feed $L_o$ is updated to the distance between the next specified line position and the front end position of the sheet 2, based on the position assumed by the front end of the sheet 2 at this time. According to the results of the decisions made in steps 39, 45, and 51, the amount of line feed executed is always set to the established amount of line feed $L_o$, i.e., the distance between the specified line feed position and the front end position of the sheet 2 (step 57). The number of the driving pulses applied to the feed motor 17 is stored in the working memory 23 as this amount of line feed executed. Then, the line position is varied by the established amount of line feed $L_o$ in response to the signal delivered from the working memory 23 to the control circuit 18 (step 58).

Where the line position is so set that the front end of the sheet of paper 2 reaches the position e, the line feed operation involving an idle movement is carried out in the manner described now. When the specified line position is set to this position, the established amount of line feed $L_o$ is set equal to the distance between the position e and the TOF position. The number of the driving pulses applied to the feed motor 17 is stored in the working memory 23 as this established amount of line feed $L_o$.

Then, a decision is made, based on the signal produced from the working memory 23 to the control circuit 18, to see whether the front end of the sheet 2 has reached the position a (FIG. 4) when the TOF position is assumed (step 39). Also, a decision is made to determine whether the front end of the sheet 2 passes across the position a if the line position is shifted from the TOF position by the established amount of line feed $L_o$ (step 40). Based on the results of these decisions, the amount of line feed executed is set equal to the distance between the position a and the front end of the sheet 2, i.e., the distance between the position a and the TOF position (step 41). The established amount of line feed $L_o$ is updated to the distance between the established amount of line feed $L_o$ and the amount of line feed executed, i.e., (the distance between the position e and the TOF position)−(the distance between the position a− the TOF position)= the distance between the positions e and a (step 42). The number of the driving pulses applied to the feed motor 17 is stored in the working memory 23 as the amount of line feed executed and as the established amount of line feed $L_o$. The line position is altered by the amount of line feed executed, or the distance between the position a and the TOF position, according to the signal produced from the working memory 23 to the control circuit 18 (step 43). By this line feed operation, the front end of the sheet 2 is moved from the TOF position to the position a. The number of the driving pulses applied to the feed motor 17 until the front end of the sheet 2 moves from the TOF position to the position a is stored in the working memory 23 as the position a assumed by the front end of the sheet 2 at this time. When the front end of the sheet arrives at this position, the print head 8 is reciprocated once idly (step 44).

Subsequently, a decision is made to ascertain whether the front end position a of the sheet 2 stored in the working memory 23 has reached the position b (FIG. 4) (step 45). Also, a decision is made to see if the front end of the sheet 2 passes across the position b when the established amount of line feed $L_o$, or the distance between the positions e and a, is traveled from the position a (step 46). Based on the results of these decisions, the amount of line feed executed is set equal to the distance between the position b and the front end of the sheet 2, i.e., the distance between the positions b and a (step 47). The established amount of line feed $L_o$ is updated to the difference between the established amount of line feed $L_o$ and the amount of line feed executed, i.e., (the distance between the positions e and a) −(the distance between the positions b and a) =the distance between the positions e and b (step 48). The number of the driving pulses applied to the feed motor 17 is stored in the working memory 23 as this amount of line feed executed and as this established amount of line feed $L_o$. The line position is changed by the amount of line feed executed, i.e., the distance between the positions b and a, in response to the signal delivered from the working memory 23 to the control circuit 18 (step 49). By this line feed operation, the front end of the sheet 2 is moved from the position a to the position b. The number of the driving pulses applied to the feed motor 17 is stored in the working memory 23 as this position b of the front end of the sheet 2. When the front end of the sheet 2 arrives at this position, the print head 8 is again reciprocated once idly (step 50).

Thereafter, a decision is made to determine whether the position b of the front end of the sheet 2 stored in the working memory 23 has reached the position c (FIG. 4) (step 51). Also, a decision is made to see if the front end position d of the sheet 2 passes across the position c when the line position is varied from the position b by the established amount of line feed $L_o$, or the distance between the positions e and b (step 52). Based on the results of these decisions, the amount of line feed executed is set to the established amount of line feed $L_o$, i.e., set equal to the distance between the positions e and b (step 57). The number of the driving pulses applied to the feed motor 17 is stored in the working memory 23 as this amount of line feed executed. The line position is changed by the established amount of line feed $L_o$ in response to the signal produced from the working memory 23 to the control circuit 18 (step 58). Thus, the front end of the sheet 2 is shifted from the position b to the position e. The sheet 2 is brought into the specified line position.

After the sheet 2 arrives at this specified line position, the next line feed operation is carried out. At this time, the specified line feed position is so set, e.g., to a position h shown in FIG. 4, that the front end of the sheet 2 passes across the position c. In particular, the spacing between the positions b and c is set to one third of the pitch between the successive lines and so if the next line feed operation is started at the position e, then the specified line position is so set that the front end of the sheet 2 passes across the position c. If the specified line position is set to this position, then the established amount of line feed $L_o$ is set equal to the distance between the positions h and e. The number of the driving pulses applied to the feed motor 17 is stored in the working memory 23 as this established amount of line feed $L_o$.

Based on the decisions made in steps 39, 45, 51, and 52, the amount of line feed executed is set equal to the distance between the position c and the front end position of the sheet 2, i.e., the distance between the positions c and e (step 53). The established amount of line feed $L_o$ is updated to the difference between the established amount of line feed $L_o$ and the amount of line feed executed, i.e., (the distance between the positions h and e) −(the distance between the positions c and e) =the distance between the positions h and c (step 54). The number of the driving pulses applied to the feed motor 17 is stored in the working memory 23 as this amount of line feed executed and as the established amount of line feed $L_o$. The line position is varied by the amount of line feed executed, i.e., the distance between the positions c and e, in response to the signal delivered from the working memory 23 to the control circuit 18 (step 55). The front end of the sheet 2 is moved from the position e to the position c by this line feed operation. The number of the driving pulses applied to the feed motor 17 is stored in the working memory 23 as the position c assumed by the front end of the sheet 2 at this time. When the front end of the sheet 2 arrives at this position, the print head 8 is caused to make one idle reciprocation (step 56).

Subsequently, the amount of line feed executed is set equal to the established amount of line feed $L_o$, i.e., set equal to the distance between the positions h and c (step 57). The number of the driving pulses applied to the feed motor 17 is stored in the working memory 23 as this amount of line feed. Then, the line position is varied by this established amount of line feed $L_o$ in response to the signal delivered from the working memory 23 to the control circuit 18 (step 58). As a result, the front end of the sheet 2 moves from the position c to the position h. The specified line position is such that the front end of the sheet 2 passes across the position c.

After the sheet 2 reaches this specified line position, the next line feed operation is carried out. At this time, the established amount of line feed $L_o$ is updated to the distance between the next specified line position and the front end position of the sheet 2. Based on the results of the decisions made in steps 39, 45, and 51, the amount of line feed executed is set to the established amount of line feed $L_o$, i.e., set equal to the distance between the specified line position and the front end position of the sheet 2 (step 57). The line position is changed by this established amount of line feed $L_o$ (step 58).

Where the specified line position is so set that the front end of the sheet 2 arrives at the position f, the line feed operation is executed in the manner described below. When the specified line position is set to this position, the established amount of line feed $L_o$ is set equal to the distance between the position f and the TOF position. The number of the driving pulses applied to the feed motor 17 is stored in the working memory 23 as this established amount of line feed $L_o$.

A decision is made, based on the signal delivered from the working memory 23 to the control circuit 18, to ascertain whether the front end of the sheet 2 has reached the position a when the TOF position is taken up (FIG. 4) (step 39). A decision is made to see if the front end of the sheet 2 passes across the position a when the line position is varied from the TOF position by the established amount of line feed $L_o$ (step 40). Based on the results of these decisions, the amount of line feed executed is set equal to the distance between the position a and the position of the front end of the sheet 2, i.e., set equal to the distance between the positions a and TOF (step 41). The established amount of line feed $L_o$ is updated to the difference between the established amount of line feed $L_o$ and the amount of line feed executed, i.e., (the distance between the positions f and TOF)−(the distance between the positions a and TOF)=the distance between the positions f and a (step 42). The number of the driving pulses applied to the feed motor 17 is stored in the working memory 23 as this amount of line feed executed and as the established amount of line feed $L_o$. The line position is varied by the amount of line feed, or the distance between the positions a and TOF, in response to the signal delivered from the working memory 23 to the control circuit 18 (step 43). This line feed operation brings the front end of the sheet 2 from the TOF position to the position a. The number of the driving pulses applied to the feed motor 17 is stored in the working memory 23 as the position a assumed by the front end of the sheet 2 at this time. When the front end of the sheet 2 arrives at this position, the print head 8 is reciprocated once idly (step 44).

Thereafter, a decision is made to see whether the position a of the front end of the sheet 2 stored in the working memory 23 has reached the position b (FIG. 4) (step 45). Also, a decision is made to determine whether the front end of the sheet 2 passes across the position b when the line position is varied from the position a by the established amount of line feed $L_o$, i.e., the distance between the positions f and a (step 46). According to the results of these decisions, the amount of line feed is set to the established amount of line feed $L_o$, i.e., set equal to the distance between the positions f and a (step 57). The number of the driving pulses applied to the feed motor 17 is stored in the working memory 23 as this amount of line feed executed. The line positions is changed by this established amount of line feed $L_o$ in response to the signal supplied from the working memory 23 to the control circuit 18 (step 58). Thus, the front end of the sheet 2 is moved from the position a to the position f. As a result, the sheet 2 is brought into the specified line position.

After the sheet 2 reaches this specified line position, the next line feed operation is carried out. At this time, the specified line position is set to a position i (FIG. 4), for example, such that the front end of the sheet 2 passes across the position c. In particular, the spacing between the positions b and c is set to one third of the pitch between the successive lines. Also, the spacing between the positions a and b is set to one third of the pitch between the successive lines. Therefore, the specified line position is so set that the front end of the sheet 2 passes across the position c when the line position is moved to the next line position from the position f. If the specified line position is set to this position, the established amount of line feed $L_o$ is set equal to the distance between the positions i and f. The number of the driving pulses applied to the feed motor 17 is stored in the working memory 23 as this established amount of line feed $L_o$.

Based on the results of the decisions made in steps 39, 45, and 46, the amount of line feed executed is set equal to the distance between the position b and the position of the front end of the sheet 2, i.e., the distance between the positions b and f (step 47). Also, the established amount of line feed $L_o$ is updated to the difference between the established amount of line feed $L_o$ and the amount of line feed executed, i.e., (the distance between the positions i and f)−(the distance between the positions b and f)=the distance between the positions i and b (step 48). The number of the driving pulses applied to the feed motor 17 is stored in the working memory 23 as this amount of line feed executed and as the established amount of line feed $L_o$. The line position is varied by the amount of line feed, i.e., the distance between the positions b and f, according to the signal delivered from the memory 23 to the control circuit 18 (step 49). By this line feed operation, the front end of the sheet 2 is moved from the position f to the position b. The number of the driving pulses applied to the feed motor 17 is stored in the working memory 23 as the position b assumed by the front end of the sheet 2 as this time. When the front end of the sheet 2 reaches this position, the print head 8 is reciprocated once idly (step 50).

Subsequently, a decision is made to see whether the front end position b of the sheet 2 stored in the working memory 23 has arrived at the position c (FIG. 4) (step 51). A decision is made to ascertain whether the front end of the sheet 2 crosses the position c when the line position is changed by the established amount of line feed $L_o$ from the position b (step 52). Based on the results of these decisions, the amount of line feed executed is set equal to the distance between the position c and the position of the front end of the sheet 2, i.e., the distance between the positions c and b (step 53). The established amount of line feed $L_o$ is updated to the difference between the established amount of line feed $L_o$ and the amount of line feed executed, i.e., (the distance between the positions i and b)−(the distance between the positions c and b)=the distance between the positions i and c (step 54). The number of the driving pulses applied to the feed motor 17 is stored in the working memory 23 as this amount of line feed executed and as this established amount of line feed $L_o$. The line position is varied by the amount of line feed executed, or the distance between the positions c and b, according to the signal produced from the working memory 23 to the control circuit 18 (step 55). By this line feed operation, the front end of the sheet 2 is moved from the position b to the position c. The number of the driving pulses applied to the feed motor 17 is stored in the working memory 23 as the distance between the front end position c of the sheet 2 and the TOF position. When the front end of the sheet 2 reaches this position, the print head 8 is again reciprocated once idly (step 56).

Thereafter, the amount of line feed executed is set to the established amount of line feed $L_o$, i.e., the distance between the positions i and c (step 57). The number of the driving pulses applied to the feed motor 17 is stored in the working memory 23 as this amount of line feed executed. The line position is changed by the established amount of line feed $L_o$ in response to the signal produced from the working memory 23 to the control circuit 18 (step 58). Thus, the front end of the sheet 2 is shifted from the position c to the position i. As a result, the sheet 2 is brought into the specified line position.

After the sheet 2 arrives at this specified line position, the next line feed operation is performed. At this time, the established amount of line feed $L_o$ is updated to the distance between the next specified line position and the front end position of the sheet 2. Based on the results of the decisions made in steps 39, 45, and 51, the established amount of line feed $L_o$ is set to the established amount of line feed $L_o$, i.e., the distance between the specified line position and the front end position of the sheet 2 (step 57). The line position is varied by this established amount of line feed $L_o$ (step 58).

The operation performed when the specified line position is so set that the front end of the sheet of paper 2 reaches the position g is next described. When the specified line position is set to this position, a displacement Lg caused when the front end of the sheet 2 moves from the TOF position to the position g is set equal to the distance between the position g and the TOF position. Based on the results of the decisions made in steps 39 and 40, the amount of line feed executed is set to the established amount of line feed $L_o$, i.e., the distance between the position g and the TOF position (step 57). The number of the driving pulses applied to the feed motor 17 is stored in the working memory 23 as this amount of line feed executed. The line position is changed by this established amount of line feed $L_o$ according to the signal delivered from the working memory 23 to the control circuit 18 (step 58).

This line feed operation is repeated until the front end of the sheet 2 passes beyond the position a when the specified line position is set. When the specified line position is set to the position f or e, for example, such that the front end of the sheet 2 passes beyond the position a, the line feed operation is effected similarly, based on the position assumed by the front end of the sheet 2 at this time.

Where the setting at the TOF position is such that the front end of the sheet 2 passes beyond the positions a, b, and c and reach downstream of the discharge rollers 15, the feeding of the sheet 2 is halted when the front end of the sheet 2 reaches the positions a, b, and c by the line feed operation to the TOF position. Under these halted conditions, the print head 8 is moved idly.

Accordingly, when a line feed operation involving an idle movement is being carried out, if the front end of the sheet 2 arrives at the positions a, b, c immediately before the front end is caught between the discharge rollers 15, the feeding of the sheet 2 is stopped temporarily at these positions. At each of these positions, the print head 8 is caused to make an idle movement, and then the sheet 2 is transported between the discharge rollers 15. Therefore, if the front end portion of the sheet 2 curls to a great extent as indicated by the phantom line in FIG. 1, the curl of the sheet 2 is reduced by the idle movement of the head 8 immediately before the front end of the sheet 2 is caught between the discharge rollers 15. Consequently, if the diameter of the discharge rollers 15 is set small, the sheet 2 can be supplied between the discharge rollers 15 with certainty.

In the above embodiment, the feeding of the sheet 2 is halted when the front end of the sheet 2 arrives at the positions a, b, and c. Under the halted conditions, the print head 8 is moved idly. In a modified embodiment, the feeding velocity of the sheet 2 is reduced temporarily when the front end of the sheet 2 reaches the positions a, b, and c. During this slow feeding, the print head 8 is caused to make an idle movement.

Also, in the above embodiment, the spacing between the positions a and b and the spacing between the positions b and c are set to one third of the pitch between the successive lines. The spacing between the positions may be set at will. For instance, this spacing between the positions can be set larger than the pitch between the successive lines.

Furthermore, in the above embodiment, the print head 8 is moved idly when the front end of the sheet 2 arrives at the positions a, b, and c. Alternatively, the head 8 may be moved idly once immediately before the front end of the sheet 2 arrives between the discharge rollers 15.

As described thus far, in accordance with the inventive method of feeding paper, it is assured that the paper is conveyed between the discharge rollers if the discharge rollers mounted downstream of the print head are designed to have a small diameter. This contributes to an improvement in the reliability of a small-sized printer where the discharge rollers have a small diameter.

What is claimed is:

1. A method for feeding paper between a pair of transport rollers mounted downstream of a print head, the paper having a front end and a pair of opposite side edges, comprising the steps of:

moving the head idly in a direction perpendicular to the direction of movement in which the paper is fed, at least once, substantially from one edge of the paper to the other edge thereof, immediately before the front end of the paper arrives between the transport rollers; and then feeding the paper between the transport rollers.

2. A method for feeding paper as set forth in claim 1, wherein the feeding of paper is halted before the front end of the paper arrives between the transport rollers, and wherein said step of moving the head idly is carried out under this halted condition.

3. A method for feeding paper in a printer having a printhead and transport roller means downstream of said printhead in a first direction, the printhead being movable across said paper in a second direction transverse to said first direction, the paper having a leading end and first and second opposite side edges, the improvement comprising feeding said paper in said first direction, past said printhead toward said transport roller means, determining the arrival of said leading edge of said paper at a first position between said printhead and transport roller means, moving said printhead across said paper in said second direction substantially between said first and second side edges, at least once, in response to a determination that said leading edge has arrived at said first position, and the feeding said paper in said first direction to said transport roller means.

4. The method of claim 3 wherein said step of moving said printhead comprises moving said printhead across said paper in said second direction without printing.

5. The method of claim 4 further comprising stopping said paper with said leading edge at said first position during said step of moving said printhead in said second direction.

6. The method of claim 3 wherein said transport roller means comprises a pair of opposed rollers defining a nip, and said first position is between said printhead and said nip.

7. A method for feeding paper in a printer having a printhead and transport roller means downstream of said printhead in a first direction, the printhead being movable across said paper in a second direction transverse to said first direction, the paper having a leading edge, the improvement comprising feeding said paper in said first direction, past said printhead toward said transport roller means, determining the arrival of said leading edge of said paper at a first position between said printhead and transport roller means, moving said printhead across said paper in said second direction in response to a determination that said leading edge has arrived at said first position, and then feeding said paper in said first direction to said transport roller means, said step of moving said printhead comprising moving said printhead across said paper in said second direction without printing.

said step of feeding comprising moving said paper in said first direction at a first rate, and further comprising feeding said paper at a second rate slower than said first rate during said step of moving said printhead in said second direction.

8. A method for feeding paper in a printer having a printhead and transport roller means downstream of said printhead in a first direction, the printhead being movable across said paper in a second direction transverse to said first direction, the paper having a leading edge, the improvement comprising feeding said paper in said first direction, past said printhead toward said transport roller means, determining the arrival of said leading edge of said paper at a first position between said printhead and transport roller means, moving said printhead across said paper in said second direction in response to a determination that said leading edge has arrived at said first position, and then feeding said paper in said first direction to said transport roller means, and further comprising determining the arrival of said leading edge of said paper at least one further position between said first position and said transport roller means, and moving said printhead in said second direction across said paper in response to each determination of the arrival of said leading edge at each said further position.

9. A method for feeding paper in a printer having a printhead and transport rollers downstream of said printhead in a first direction, the printhead being is movable across said paper in a second direction transverse to said first direction, the paper having a leading end and first and second side edges, said method comprising feeding said paper in said first direction, past said printhead toward said transport rollers, determining the arrival of said leading end of said paper at a first position between said printhead and transport rollers, moving said printhead across said paper in said second direction substantially from said first edge to said second edge, at least once, without printing on said paper, in response to a determination that said leading end has arrived at said first position, to minimize curling of said paper at said leading edge, and then feeding said paper in said first direction to said transport rollers.

10. The method of claim 9 further comprising stopping said feeding of said paper during said step of moving said printhead across said paper.

* * * * *